US010307649B1

(12) United States Patent
Martens et al.

(10) Patent No.: US 10,307,649 B1
(45) Date of Patent: Jun. 4, 2019

(54) MULTI-MATERIAL IRON GOLF CLUB HEAD

(71) Applicant: Acushnet Company, Fairhaven, MA (US)

(72) Inventors: Grant M. Martens, San Diego, CA (US); Uday V. Deshmukh, Carlsbad, CA (US); Charles E. Golden, Encinitas, CA (US); Jonathan Hebreo, San Diego, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 15/833,935

(22) Filed: Dec. 6, 2017

(51) Int. Cl.
*A63B 53/04* (2015.01)

(52) U.S. Cl.
CPC .. *A63B 53/0475* (2013.01); *A63B 2053/0408* (2013.01); *A63B 2053/0491* (2013.01)

(58) Field of Classification Search
CPC ..... A63B 53/0475
See application file for complete search history.

(56) References Cited

U.S. PATENT DOCUMENTS 1,894,706 A 1/1933 Reach
3,979,122 A 9/1976 Belmont
4,664,383 A 5/1987 Aizawa
4,792,139 A 12/1988 Nagasaki et al.
4,798,383 A 1/1989 Nagasaki et al.
4,826,172 A 5/1989 Antonious
4,883,275 A * 11/1989 Boone ..... A63B 53/04 473/334
4,884,812 A 12/1989 Nagasaki et al.
4,964,640 A 10/1990 Nakanishi et al.
5,184,823 A 2/1993 Desboilles et al.
5,328,175 A 7/1994 Yamada
5,363,487 A 11/1994 Willman et al.
5,421,577 A 6/1995 Kobayashi
5,429,358 A 7/1995 Rigal et al.
5,430,845 A 7/1995 Rimmer et al.
5,439,223 A 8/1995 Kobayashi
5,822,614 A 10/1998 Kenton et al.
5,867,730 A 2/1999 Leyda
5,870,732 A 2/1999 Fisher et al.
5,898,843 A 4/1999 Crump et al.
5,904,628 A 5/1999 MacKay, Jr. et al.
5,985,197 A 11/1999 Nelson et al.
6,044,442 A 3/2000 Jesionowski
6,115,815 A 9/2000 Doragh et al.
6,248,025 B1 6/2001 Murphy et al.
6,319,150 B1 11/2001 Werner et al.
6,343,324 B1 1/2002 Hubis et al.
(Continued)

*Primary Examiner* — Michael D Dennis
(74) *Attorney, Agent, or Firm* — Randy K. Chang

(57) ABSTRACT

A multi-material iron type golf club head is disclosed. More specifically, the golf club head in accordance with the present invention may have a metallic portion and a lightweight portion, wherein the entirety of the striking face is made out of a metallic material while a majority of the chassis is made out of a lightweight material that serves to reduce the overall weight of the golf club head. The lightweight material, in addition to reducing the overall weight of the golf club head, may be comprised of an interior face support to at least partially support the metallic striking face portion to improve the performance and feel of the golf club head.

19 Claims, 9 Drawing Sheets

(56) References Cited

U.S. PATENT DOCUMENTS

| | | | | |
|---|---|---|---|---|
| 6,398,666 | B1 | 6/2002 | Evans et al. | |
| 6,592,469 | B2 | 7/2003 | Gilbert | |
| 6,616,546 | B2 | 9/2003 | Cho | |
| 6,697,924 | B2 | 2/2004 | Gilbert | |
| 7,281,991 | B2 | 10/2007 | Gilbert | |
| 7,399,238 | B2 * | 7/2008 | Hocknell ..... | A63B 53/0466 473/342 |
| 2001/0055996 | A1 | 12/2001 | Iwata et al. | |
| 2003/0083151 | A1 | 5/2003 | Nakahara et al. | |
| 2003/0148818 | A1 | 8/2003 | Myrhum | |
| 2004/0023730 | A1 | 2/2004 | Nagai | |
| 2005/0009626 | A1 | 1/2005 | Imamoto et al. | |
| 2005/0124437 | A1 | 6/2005 | Imamoto | |

* cited by examiner

MULTI-MATERIAL IRON GOLF CLUB HEAD

FIELD OF THE INVENTION

The present invention relates generally to a multi-material iron golf club head. More specifically, the present invention relates to a multi-material iron golf club head wherein the entirety of the striking face is made out of a metallic material while a majority of the rear chassis is made out of a lightweight material that serves to reduce the amount of mass associated with the metallic portion. In addition to the above, the present invention can further improve upon the performance of the golf club head by at least partially supporting the metallic striking face portion of the golf club head with the lightweight material used for the rear chassis, providing structural support to the striking face, reduce stress, and improve the feel of the golf club head.

BACKGROUND OF THE INVENTION

In order to keep up with the increasing demands of the golfing public for more technology and performance from their iron type golf club heads, golf club designers have been forced to change the design of iron type golf club heads away from traditional muscle back construction in order to keep up with this trend.

One of the earliest attempts to improve the performance of the iron was to improve the moment of inertia of a golf club head by adding weight to the perimeter of the golf club head to create more forgiveness in off-center shots. U.S. Pat. No. 4,826,172 to Antonious provides an illustration of this technology by showing a perimeter weighted iron-type golf club head with a recessed or cavity back and a peripheral mass having an improved weight configuration.

Another way to improve the forgiveness of an iron type golf club head in addition to removing weight from the central portion and moving it out on the perimeter as illustrated above is to use exotic materials that are heavier than steel. The utilization of exotic materials that are heavier than steel allows more discretionary weight to be created in the same footprint, further improving the performance of an iron type golf club head. U.S. Pat. No. 3,845,960 to Thompson illustrates this principle by placing tungsten powder at the heel and toe end of the golf club head to improve the moment of inertia of the golf club head.

With the development of more advanced materials, the infatuation with lightweight materials such as carbon fiber composite has also worked its way into golf club design, creating yet another way to improve upon the forgiveness of an iron type golf club head. U.S. Pat. No. 4,664,383 to Aizawa provides an early example of this by creating a golf club with resin with woven material as well as resin with non-oriented fibers to create a golf club head.

In addition to making the golf club more forgiving as shown by the three above examples, another way to improve the performance of an iron type golf club head is to improve the ballspeed of the iron type golf club head. One way to achieve this is to decrease the thickness of the striking face of the golf club head. U.S. Pat. No. 6,592,469 to Gilbert provides an example of this technology by teaching a golf club with a thin front face for striking a golf ball and a peripheral weighting surrounding the back of the front face and defining a cavity.

Despite all the attempts to improve the performance of an iron type golf club, none of the designs have been able to combine all of the best characteristics of each individual technology in one compact convenient package. More specifically, none of the designs incorporate advanced material technology to increase the forgiveness and ballspeed of the iron type golf club head in one unitary golf club chassis without sacrificing the aesthetic appeal of the golf club.

BRIEF SUMMARY OF THE INVENTION

One aspect of the present invention is an iron golf club head comprising of a metallic portion and a lightweight portion. The metallic portion further comprises of a hosel, a heel portion, a topline portion, a sole portion, a striking face, and wherein the metallic portion creates an opening near a toe side of the metallic portion. The lightweight portion further comprises an exposed toe portion, a topline support, a sole support, and an internal face support, wherein the lightweight portion slidably engages the opening near the toe side of the metallic portion. The metallic portion conceals the internal face support, the topline support, and the sole support, and the exposed toe portion of the lightweight portion is exposed externally and forms an external portion of the iron golf club head.

In another aspect of the present invention is an iron golf club head comprising of a metallic portion, a lightweight portion, a heel weight, and a toe weight. The metallic portion further comprises of a hosel, a heel portion, a topline portion, a sole portion, a striking face, and wherein the metallic portion creates an opening near a toe side of the metallic portion. The heel weight is located at a bottom heel portion of the iron golf club head while the toe weight is located at a bottom toe portion of the iron golf club head. The heel weight being retained in the iron golf club head by the metallic portion and the toe weight being retained in the iron golf club head by the lightweight portion.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
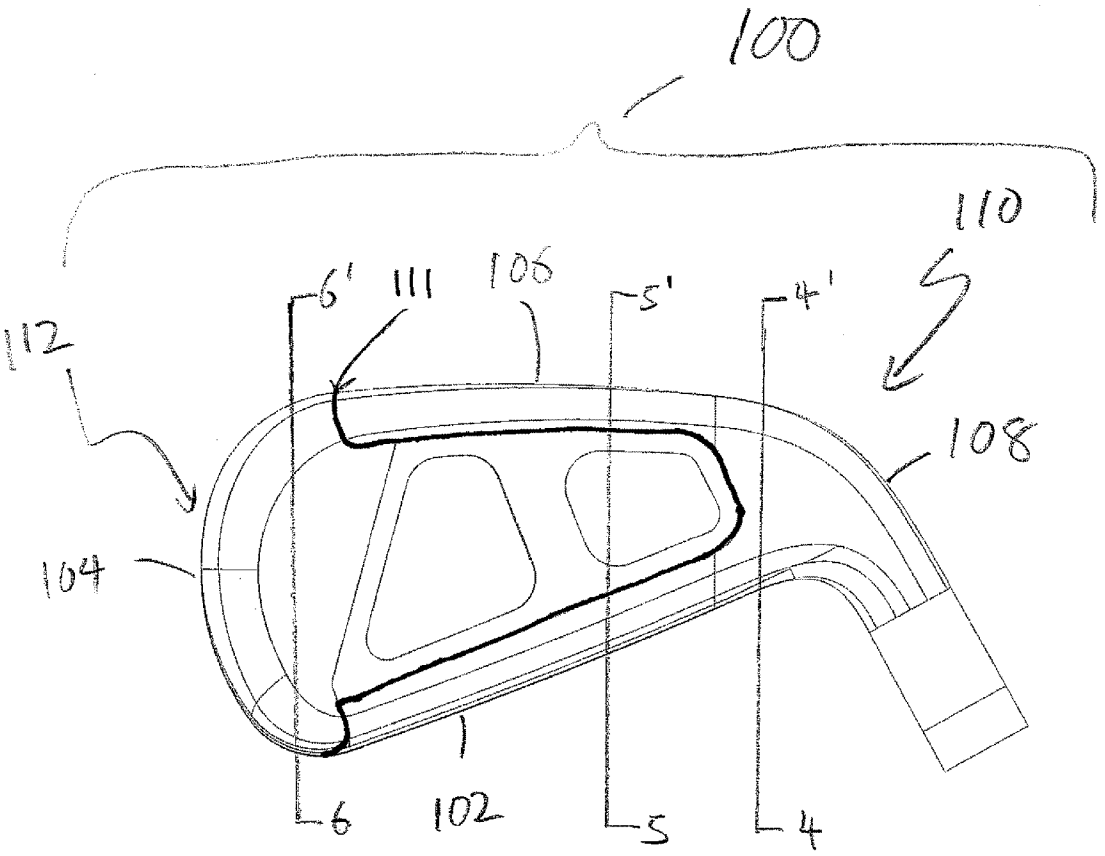
FIG. 1 shows a rear perspective view of a golf club head in accordance with an exemplary embodiment of the present invention.

FIG. 1 of the accompanying drawings shows a perspective view of a golf club head 100 in accordance with an exemplary embodiment of the present invention. More specifically, the golf club head 100 shown here may have a topline portion 102, a toe portion 104, a sole portion 106, and a heel portion 108. The golf club head 100 shown here may be separated into a metallic portion 110 and a lightweight portion 112 that is separated by a separation line 111. The separation line 111 is shown in FIG. 1 in darker and heavier lines, but should be more visible in subsequent view of the invention wherein the different components are exploded to help illustrate the separation line 111.

Figure 2:
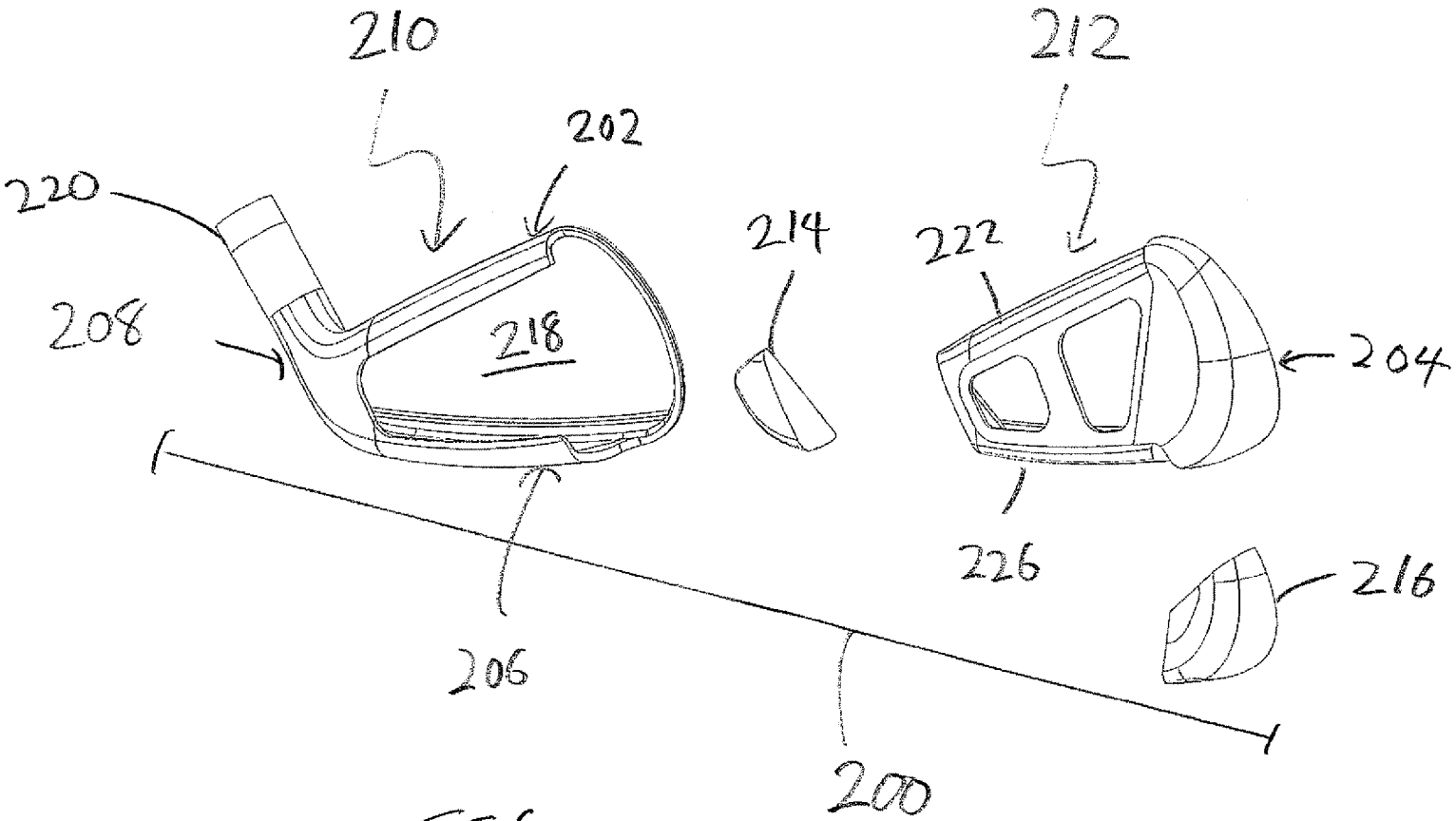
FIG. 2 shows an exploded rear perspective view of a golf club head in accordance with an exemplary embodiment of the present invention.

FIG. 2 of the accompanying drawings shows an exploded perspective view of a golf club head 200 in accordance with an exemplary embodiment of the present invention allowing the relationship between the various components of the golf club head 200 to be shown more clearly. More specifically, FIG. 2 of the accompanying drawings shows an exploded rear perspective view of the various components. First and foremost, it can be seen that golf club head 200 is comprised out of four major components, a metallic portion 210, a lightweight portion 212, a heel weight 214, and a toe weight 216. The metallic portion 210 further comprises of a striking face 218, the topline portion 202, the sole portion 206, and a heel portion 208 containing the actual hosel 220. The lightweight portion 212 in accordance with the current exemplary embodiment of the present invention may be further comprised out of the toe portion 204, an internal topline support 222, and internal sole support 226, and an internal face support (shown later as 328 in FIG. 3). The internal supports shown here allow the metallic portion 210 of the golf club head 200 to be made thinner wherever there is an overlap in material, increasing the discretionary weight available in the golf club head 200. The internal support achieves this by increasing the structural integrity of the golf club head 200 at those specific locations. The extra amount of discretionary weight achieved by the utilization of internal supports allow the golf club head 200 to include a larger than average sized heel weight 214 and toe weight 216 to increase the moment of inertia of the golf club head 200. The heel weight 214 in this embodiment of the present invention may generally be placed at a cavity created inside the bottom heel portion of the metallic portion 208, while the toe weight 216 may generally be located inside the bottom toe portion of the lightweight portion 204. Finally, although not specifically here, the separation line 111 shown in FIG. 1 can be seen more clearly in this exploded view of the golf club head 200 as the separation between the metallic portion 210 and the lightweight portion 204.

It is worth noting here how the separation between the metallic portion 210 and the lightweight portion 212 as illustrated by separation line 111 in FIG. 1 creates a unique relationship between the two components. More specifically, as shown here in FIG. 2, the lightweight portion 212 slides into an opening created by the metallic portion 210 from the toe side after the heel weight 214 is installed in the heel portion. The lightweight portion 212 here is formed with the toe weight 216 already installed, and the entirety of the two components can be installed together in one step. The lightweight portion 212 has an exposed toe portion 204 that takes on the external shape of a golf club head 200, but also contains internal components such as the internal topline support 222, internal sole support 226, and an internal face support (shown later as 328 in FIG. 3). The internal components mentioned above provide internal support for the topline 202, sole 206, and striking face 218 of the metallic portion 210 respectively, all while preserving the external cosmetics of the exposed toe portion. It should be noted that the rear portion of the golf club head 200 is only formed by the lightweight portion 212, and does not contain any metallic portion 210. This design is intentional, as the rear portion of the golf club head 200 is not subjected to as high of a stress as the other portion of the golf club head 200; hence it does not need the structural rigidity of the metallic portion 210. Alternatively, it can be said that the golf club head 200 comprises of a metallic portion 210 that is further comprised of a topline portion 202, a sole portion, 206, a striking face portion 218, and an opening orientated towards the toe portion of the golf club head. The golf club head 200 also comprises of a lightweight portion 212 that is further comprised of a topline support portion 222, a sole support portion 226, and a striking face support portion (shown as 328 in FIG. 3), wherein the lightweight support portion engages the opening of the metallic portion 210 such that the topline support portion 222 engages the topline portion 202, the sole support portion 226 engages the sole portion 206, and the striking face support portion (shown as 328 in FIG. 3) engages the striking face portion 218. Finally, it can be said that the lightweight portion 212 engages the metallic portion 210 by slidably engaging the toe opening created by the metallic portion 210.

Finally, FIG. 2 also shows an additional feature of the metallic portion 210 that helps structurally support the lightweight portion 212. More specifically, FIG. 2 shows that the topline portion 202 and the sole portion 206 may both have a wraparound undercut that spans the major portion of the metallic portion 210. The wrap around undercut is created by creating a bend in the topline portion 202 and the sole portion 206 as it departs from the striking face 218 plane and wraps around the lightweight portion 212 itself until it becomes substantially planar to that same plane again. This wraparound undercut feature helps retain the lightweight portion 212 as it slides into the opening created for it within the metallic portion 210 and provides structural rigidity to the golf club head 200 itself.

In the current exemplary embodiment, the metallic portion 210 may generally be made out of a steel material having higher strength properties. In one exemplary embodiment of the present invention, high strength steel such as Custom 455 Stainless Steel is used for its high strength properties, however numerous other types of high strength steel such as K301 steel, Aeromet 340 steel, SUP-10, or even 17-4 steel may be used without departing from the scope and content of the present invention so long as it can meet the high strength properties required for the present invention. The metallic portion 210 in accordance with an exemplary embodiment of the present invention may generally have a density of greater than about 7.0 g/cc, more preferably greater than about 7.3 g/cc, and most preferably greater than about 7.6 g/cc. The lightweight portion 212 of the present invention may generally be made out of a carbon fiber type composite material that offers lightweight characteristics as well as relative high strength. However, in alternative embodiments, the lightweight material could be created out of aluminum, plastic, rubber, or any other type of lightweight material without departing from the scope and content of the present invention. The lightweight portion 212 in accordance with an exemplary embodiment of the present invention may generally have a density less than about 3.0 g/cc, more preferably less than about 2.5 g/cc, and most preferably less than about 2.0 g/cc. Finally the toe weight 214 and the heel weight 216 shown in this embodiment may generally be made out of a tungsten type material capable of increasing the moment of inertia of the golf club head based on their strategic placement. The tungsten material used for the toe weight 214 and the heel weight 216 may have a density greater than about 12.0 g/cc more preferably greater than about 14.0 g/cc and more preferably greater than about 17.0 g/cc.

Figure 3:
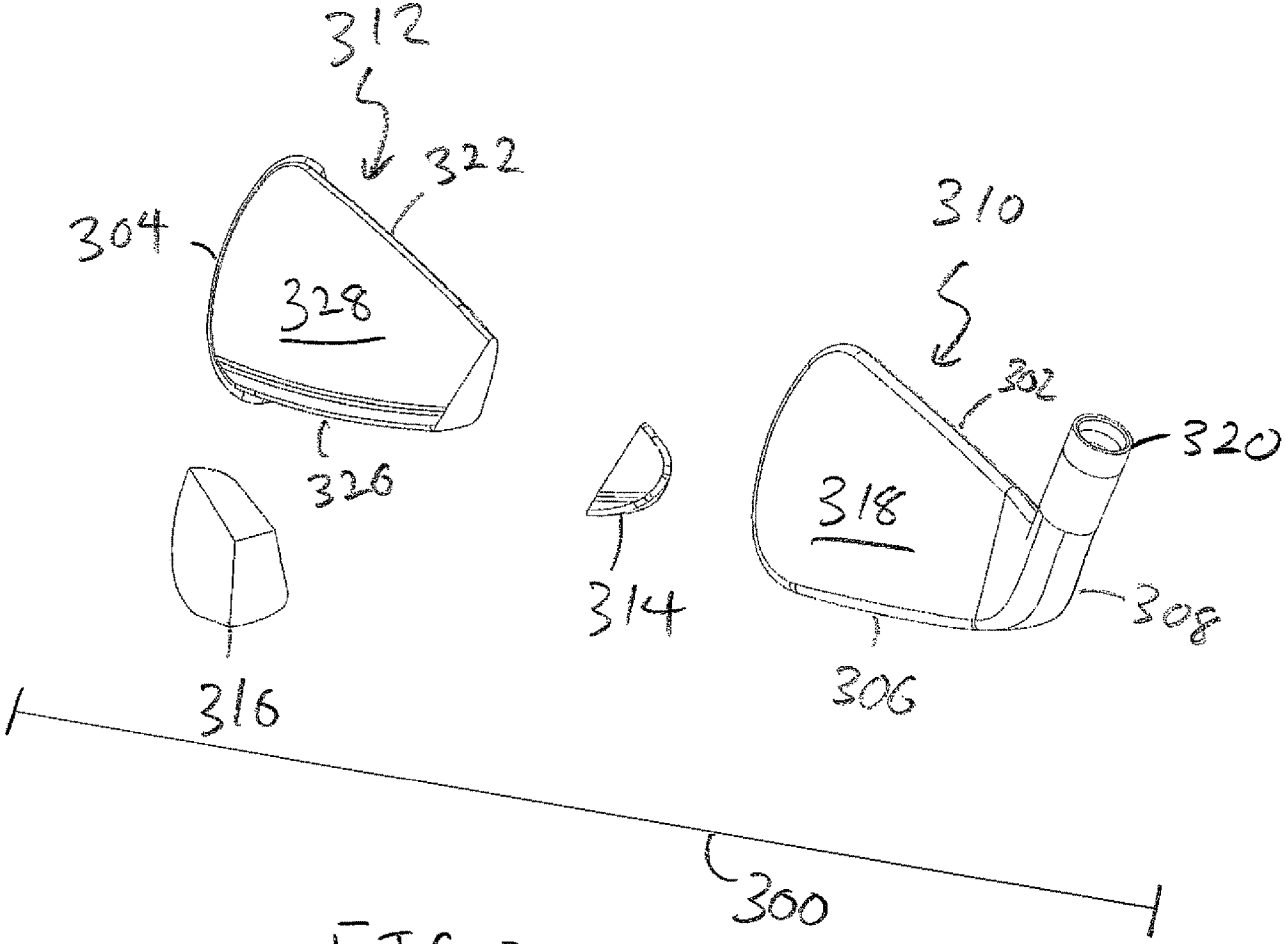
FIG. 3 shows an exploded frontal perspective view of a golf club head in accordance with an exemplary embodiment of the present invention.

In order to provide a more complete illustration of the relationship between the various components, FIG. 3 of the accompanying drawings shows an exploded perspective view of a golf club head 300 in accordance with an alternative embodiment of the present invention shown from an different angle. Golf club head 300, similar to golf club head 200 shown in FIG. 2, illustrates a metallic portion 310 containing a hosel 320 and a striking face 318 that is adapted to contact a golf ball. The metallic portion 310 also has a topline portion 302, a sole portion 306, a heel portion 308 in addition to the hosel 320 and the striking face 318. It should be noted that in this view, the opening of the metallic portion 310 is not visible, but is still orientated towards the toe portion. The heel weight 314, shown here to be exploded out from its position inside the bottom of the heel portion may generally be attached via any attachment means desired without departing from the scope and content of the present invention. The lightweight portion 312 in FIG. 3 shows the striking face support portion 328 that the previous discussion has referenced being placed at a front of the lightweight portion 312 directly behind the striking face 318 to provide structural support. In addition to the above, FIG. 3 of the accompanying drawings also shows the lightweight portion with a topline support 322, a sole support 326, and a toe portion 304. Finally, FIG. 3 also shows the toe weight 316 being extrapolated from its place near the bottom toe portion of the lightweight portion 312 for ease of illustration. As previously discussed, the toe weight 316 may be formed integrally within the lightweight portion 312 during the curing process of the composite material without departing from the scope and content of the present invention.

It is worthwhile here to mention that the lightweight portion 312 of the golf club head 300 in accordance with this exemplary embodiment is unique in its construction, geometry, and shape. To the untrained eye, the lightweight portion 312 may not possess any unique features because most golf clubs utilizes a metallic material to form the lightweight portion 312, and this geometry is easily achieved by casting a metallic part of into this shape. However, as mentioned earlier, the lightweight portion 312 in accordance with this exemplary embodiment of the present invention is formed out of a lightweight composite type material that is usually formed in layers and cured to take on its final shape. Taking a closer look at the geometry, it can be seen that the lightweight portion 312, both from the frontal and rear views shown in FIGS. 2 and 3, illustrate a complicated geometry that has multiple cutouts and curvatures generally difficult to form using composite type materials. To achieve this type of geometry, the current invention utilizes a 3D printed core lattice that has an internal geometry that matches the desired internal geometry of the lightweight portion 312. Once the 3D printed core lattice is created, the composite type material may be wrapped around the 3D printed core lattice and subsequently cured to take form. Once the composite material is cured, the internal 3D printed core lattice may be dissolved away to yield a hollow central portion to eliminate any unnecessary weight. However, in alternative embodiments of the present invention, the 3D printed core lattice may be preserved without departing from the scope and content of the present invention if it is suitable to improve the performance or sound of the golf club head 300 itself.

It should be noted that the 3D printed core is only one preferred embodiment used to form the complicated geometry in the lightweight portion 312. Numerous other types of manufacturing methods could be used without departing from the scope and content of the present invention so long as it is capable of achieving the geometry needed. One alternative manufacturing method is the utilization of an inflatable bladder. In this alternative manufacturing method, the composite material could be applied to the internal component of the metallic portion, and the internal geometry of the composite material could be formed using an inflatable bladder; wherein the entire structure may be cured before the bladder is deflated.

Figure 4:
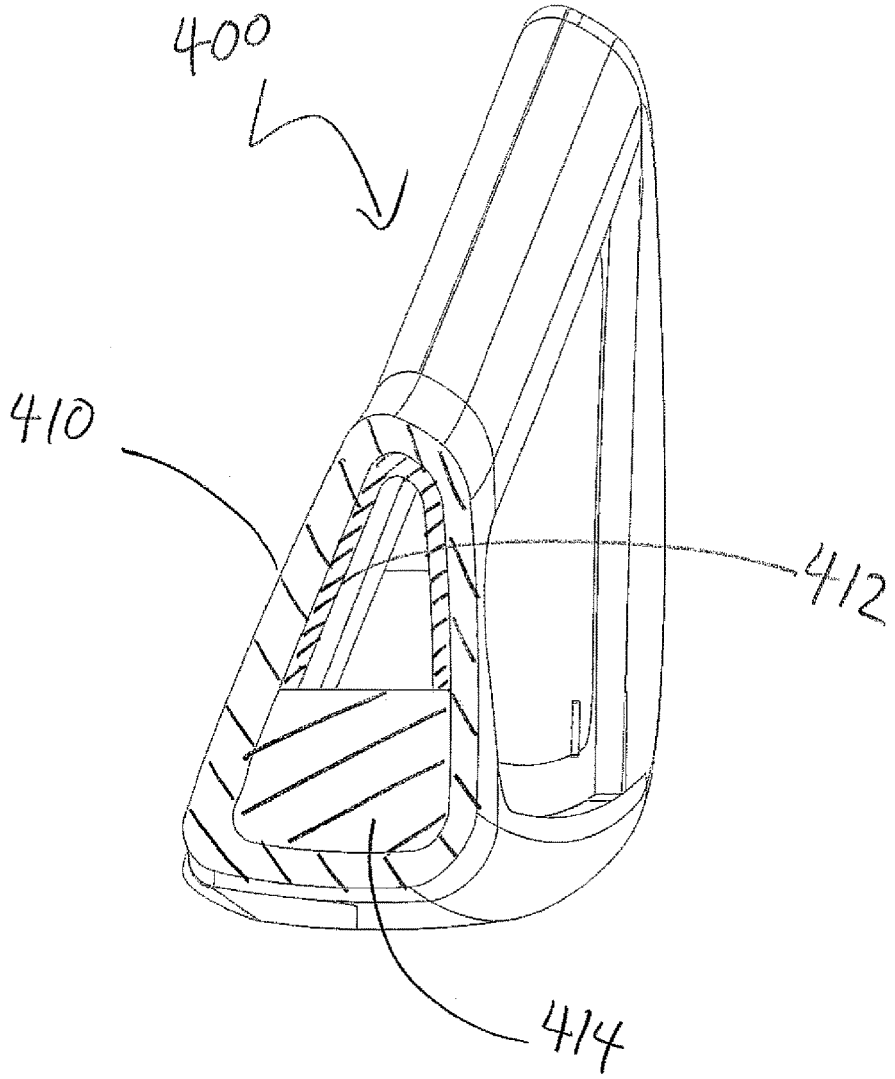
FIG. 4 shows a cross-sectional view of a golf club head in accordance with an exemplary embodiment of the present invention taken along cross-sectional line 4-4' shown in FIG. 1.
Figure 5:
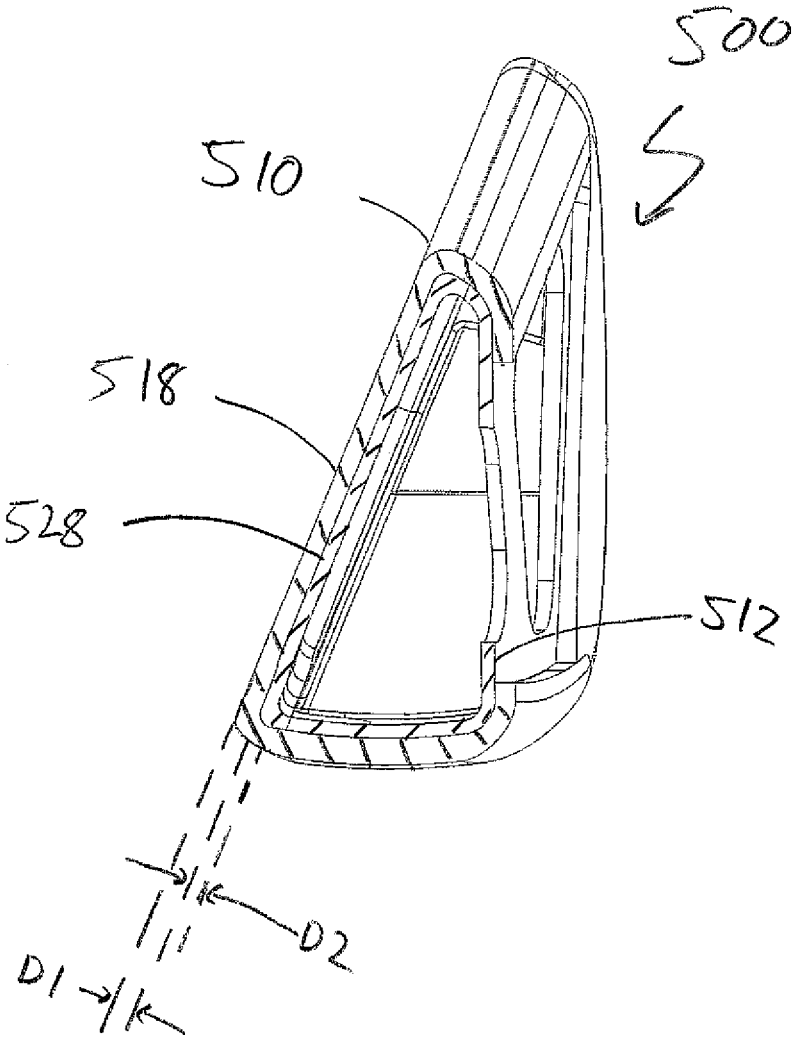
FIG. 5 shows a cross-sectional view of a golf club head in accordance with an exemplary embodiment of the present invention taken along cross-sectional line 5-5' shown in FIG. 1.
Figure 6:
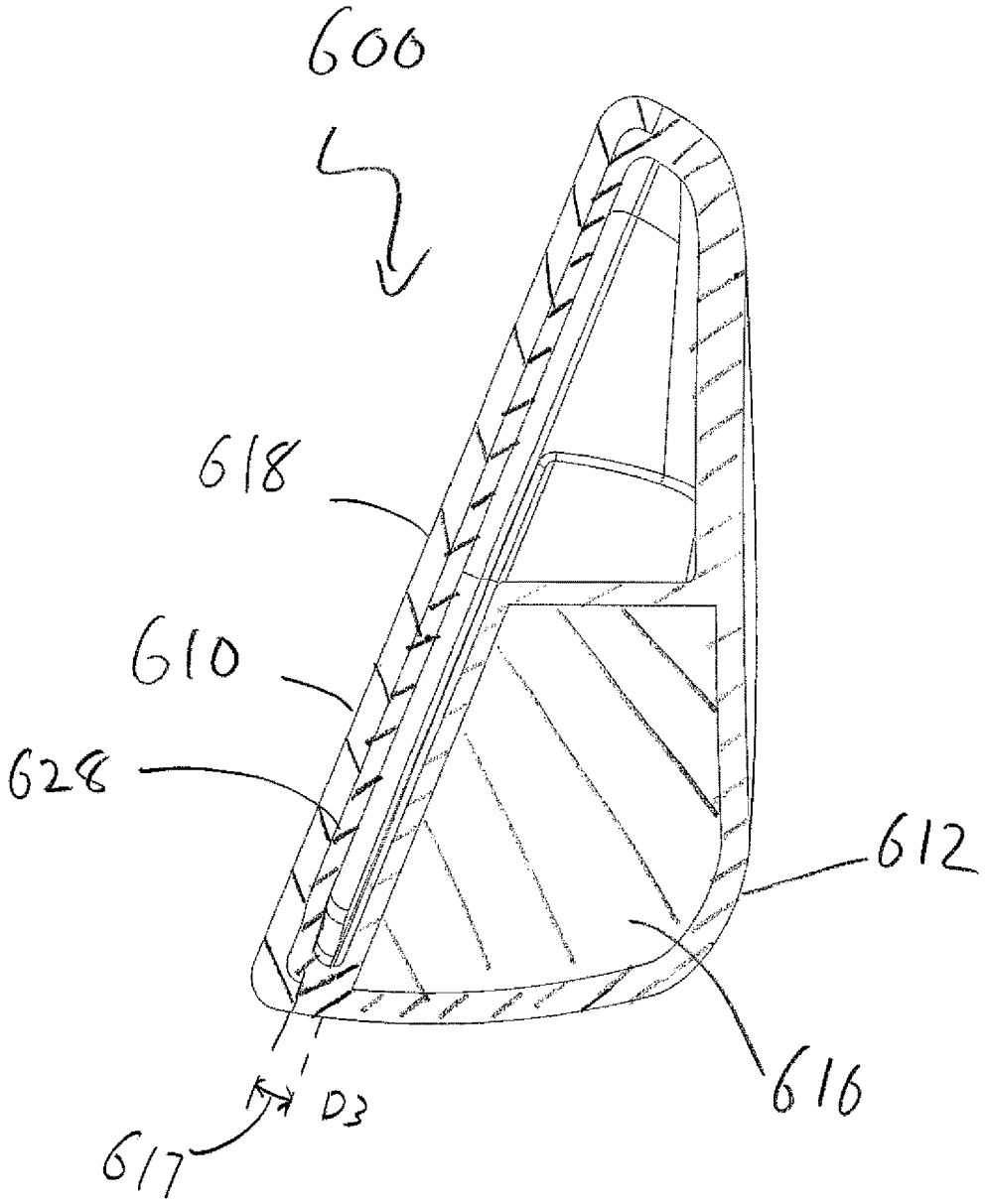
FIG. 6 shows a cross-sectional view of a golf club head in accordance with an exemplary embodiment of the present invention taken along cross-sectional line 6-6' shown in FIG. 1.

FIGS. 4, 5, and 6 of the accompanying drawings shows cross-sectional views of golf club heads 400, 500, and 600 respectively taken along cross-sectional lines 4-4', 5-5', and 6-6' shown in FIG. 1. FIG. 4 shows a cross-sectional view of a golf club head 400 in accordance with an alternative embodiment taken along cross-sectional line 4-4' to allow the relationship between the various components to be shown more clearly. More specifically, FIG. 4 of the accompanying drawings shows a metallic portion 410 located at a frontal portion of the golf club head 400 creating the striking face, while the lightweight portion 412 is shown here to be placed and inserted in behind the metallic portion 410. This cross-sectional line 4-4' is drawn across the heel weight 414 to allow the relationship between the heel weight 414 and the other components to be shown more clearly. As it can be seen here in FIG. 4, the heel weight 414 is completely enclosed by the metallic portion 410, and only contacts the lightweight portion 412, which differs from how the toe weight, which will be shown in more detail in FIG. 6.

FIG. 5 of the accompanying drawings shows a cross-sectional view of golf club head 500 in accordance with an alternative embodiment of the present invention taken along cross-sectional line 5-5' shown in FIG. 1. This cross-sectional line taken down the middle of the golf club head 500 allows the various thicknesses of the components at the center of the golf club head 500 to be defined. More specifically the thickness that we are concerned with here are the thickness of the metallic portion 510 at the striking face portion 518 and the lightweight portion 512 at the internal face support 528. The thickness of the metallic portion 510 at the striking face portion 518 is represented by D1 in FIG. 5, while the thickness of the lightweight portion 512 at the internal face support 528 is represented by D2. Thickness D1 of the striking face portion 518 in accordance with the current exemplary embodiment may generally be between about 1.0 mm and about 1.5 mm, more preferably between about 1.1 mm and about 1.4 mm, and most preferably between about 1.2 mm and about 1.4 mm all without departing from the scope and content of the present invention. The thickness D2 of the internal face support 528, on the other hand, may have a thickness of between about 0.8 mm and about 1.2 mm, more preferably between about 0.9 mm and about 1.1 mm, and most preferably about 1.0 mm all without departing from the scope and content of the present invention. The thickness of the striking face portion 518 and the internal face support 528 are critical to the proper functionality of the current inventive golf club head 500. If the thickness of the striking face is too thick, then the ballspeed performance of the golf club head 500 suffers in addition to wasting weight. On the other hand, if the thickness of the striking face is too thin, then durability of the golf club head 500 suffers. However, the lack of durability can be alleviated by the addition of the internal face support 528, thus the combination and the right balance of the various thicknesses is of the utmost importance to the present invention.

It is worth noting here that although the thickness of the striking face portion 518 is capable of getting so thin is mainly because of the structural support provided by the internal face support 528, the internal face support 528 also improves the feel of the golf club head 500 as well. As modern golf club faces get thinner and thinner to improve the performance of the golf club head 500, the thinner metallic striking face portion 518 can often feel too "clicky". The internal face support 528 that is made out of the composite type material in this embodiment of the invention helps alleviate that problem by providing a more rigid and solid feel, allowing the striking face portion 518 to get achieve this thickness.

Finally, it is worth noting here that although not specifically shown in FIG. 5, there could potentially be a viscoelastic layer sandwiched between the striking face portion 518 and the internal face support 528. The viscoelastic layer could be made out of a viscoelastic tape, a viscoelastic fluid, or any other viscoelastic composition capable of taking up any gaps between the striking face portion 518 and the internal face support 528 that could result from manufacturing tolerance.

Finally, FIG. 6 of the accompanying drawing shows a cross-sectional view of golf club head 600 in accordance with an alternative embodiment of the present invention taken along cross-sectional line 6-6' shown in FIG. 1. This cross-sectional view taken along the toe weight 616 allows the relationship of the toe weight 616 with the other components to be shown more clearly. More specifically FIG. 6 shows that the toe weight 616 is generally completely captured and retained by the lightweight portion 612. The lightweight portion 612 captures the toe weight 616 by curing itself around the toe weight 616 while the lightweight portion 612 is still in the uncured state. This type of co-forming technique allows the toe weight 616 to be pre-incorporated into the lightweight portion 612, simplifying the final assembly process.

The lightweight portion 612 here creates a gap 617 between the internal face support 628 and the wrap around the toe weight 616. This gap 617 is important to the proper functionality of golf club head 600 because it allows the striking face 618 to flex upon impact with a golf ball. Without this very important gap 617, the performance of the golf club head 600 could be limited towards the toe portion of the golf club head 600.

Figure 7:
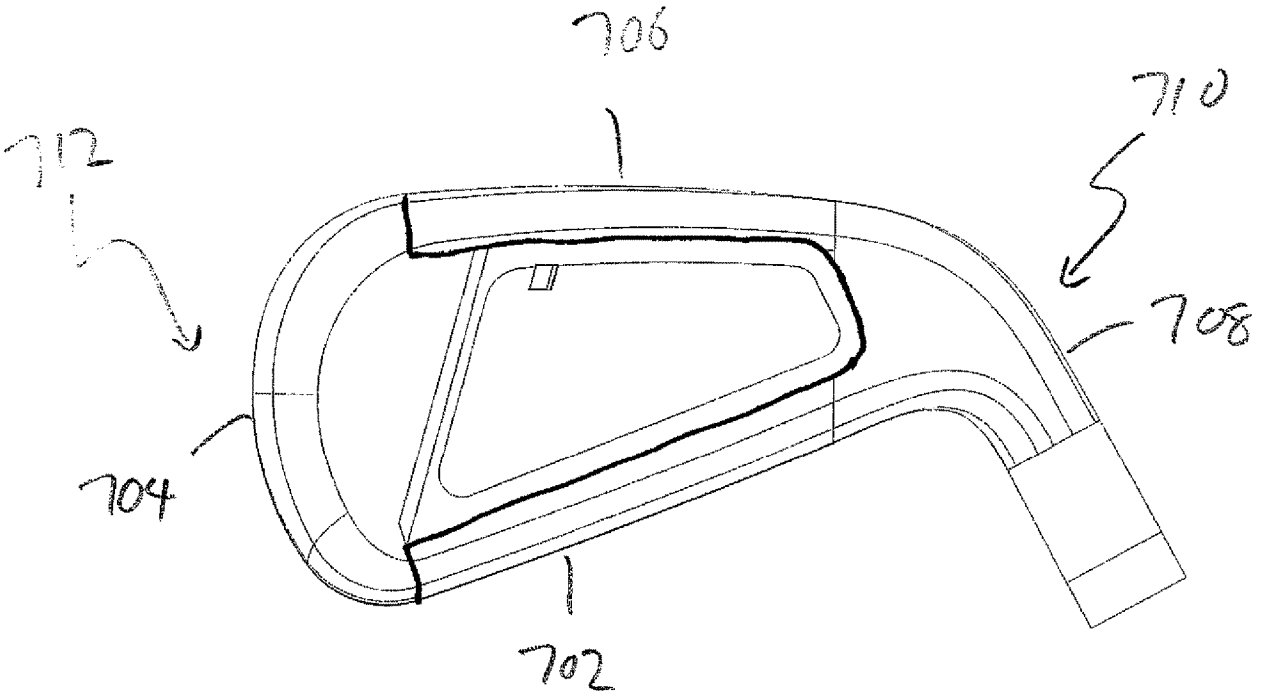
FIG. 7 shows a rear perspective view of a golf club head in accordance with an alternative embodiment of the present invention.

FIG. 7 of the accompanying drawings shows a golf club head 700 in accordance with an alternative embodiment of the present invention. Although the final assembled product may not look very different than the golf club head 100 shown in FIG. 1, the subtle differences will be evident in the subsequent discussion. More specifically, the lightweight portion 712 in this embodiment may be created using multiple pieces to further simplify the manufacturing method. FIG. 7 shows the golf club head 700 having a topline portion 702, a toe portion 704, a sole portion 706, and a heel portion 708. The golf club head 700 shown here may be separated into a metallic portion 710 and a lightweight portion 712 that is separated by a separation line 711.

Figure 8:
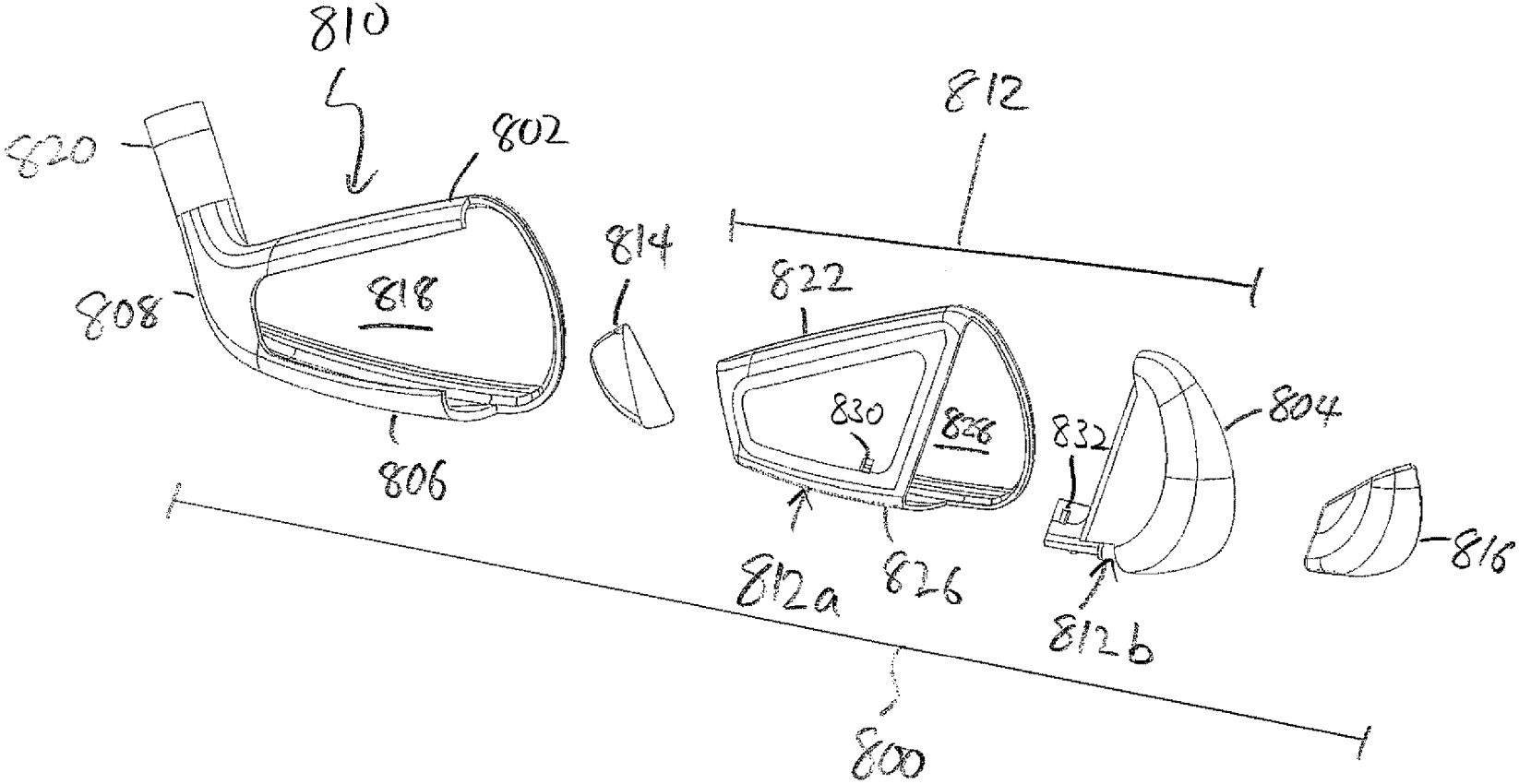
FIG. 8 shows an exploded rear perspective view of a golf club head in accordance with an alternative embodiment of the present invention.

The exploded view of golf club head 800 shown in FIG. 8 provides more detail for alternative embodiment of the present invention. Although there are a lot of components shown in this exploded view of the invention shown in FIG. 8, it differs from the previous embodiment in that the lightweight portion 812 is further separated into sub-components lightweight face portion 812*a* and lightweight toe portion 812*b*. The separation of the lightweight portion 812 into sub-components could potentially make the manufacturing of the lightweight portion 812 easier due to manufacturing constraints of the composite material that involved composite material. By separating the lightweight portion 812 into the lightweight face portion 812*a* and the lightweight toe portion 812*b*, it allows the lightweight face portion 812*a* to be created by using unitary plies of composite material that can be wrapped around a core material that can be extracted later without worrying about complex geometries. The formation of the lightweight toe portion 812*b* requires more complex formation techniques, but the stress level experienced at the lightweight toe portion 812*b* is significantly lower, thus numerous types of manufacturing techniques could be used instead that does not need to accommodate high levels of stress.

The metallic portion 810 shown in FIG. 8 is similar to previous discussions, and further comprises of a topline portion 802, a sole portion 806, a heel portion 808, a hosel 820, and a striking face portion 818. The heel weight 814 is inserted into the metallic portion 810 at the bottom heel portion of the golf club head 800 similar to the previously illustrated embodiments. The lightweight portion 812 in this embodiment, as previously discussed, is separated into two sub-components, the lightweight face portion 812*a* and the lightweight toe portion 812*b*. The lightweight face portion 812*a* comprises a topline support 822, a sole support 826, and an internal face support 828, and these support regions can provide structural support to the metallic portion 810. The lightweight toe portion 812*b* further comprises a toe portion 804 that will be externally visible once the golf club head 800 is completely assembled. The toe weight 816 in this embodiment can be easily inserted into an opening (not shown) in the lightweight toe portion 812*b*, and then assembled together with the lightweight face portion 812*a* to create the entire lightweight portion 812. Finally, it is worth noting here that in order to help the assembly between the lightweight face portion 812*a* and the lightweight toe portion 812*b*, a snap assembly is created using a tab 832 on the lightweight toe portion 812*b* and a snap opening 830 on the lightweight face portion 812*a*.

In an alternative embodiment of the present invention, the material used to form the lightweight face portion 812*a* and the lightweight toe portion 812*b* could be different from one another without departing from the scope and content of the present invention. In one example, the lightweight toe portion 812*b* could be made out of chopped fiber composite, solid composite, aluminum, magnesium or even some 3D printed material all without departing from the scope and content of the present invention. One of the reason that the lightweight toe portion 812*b* could be made from these alternative materials is because the toe portion 804 is not generally used for impacting a golf ball, hence the stress level experienced by the golf club head at those locations are generally lower.

Figure 9:
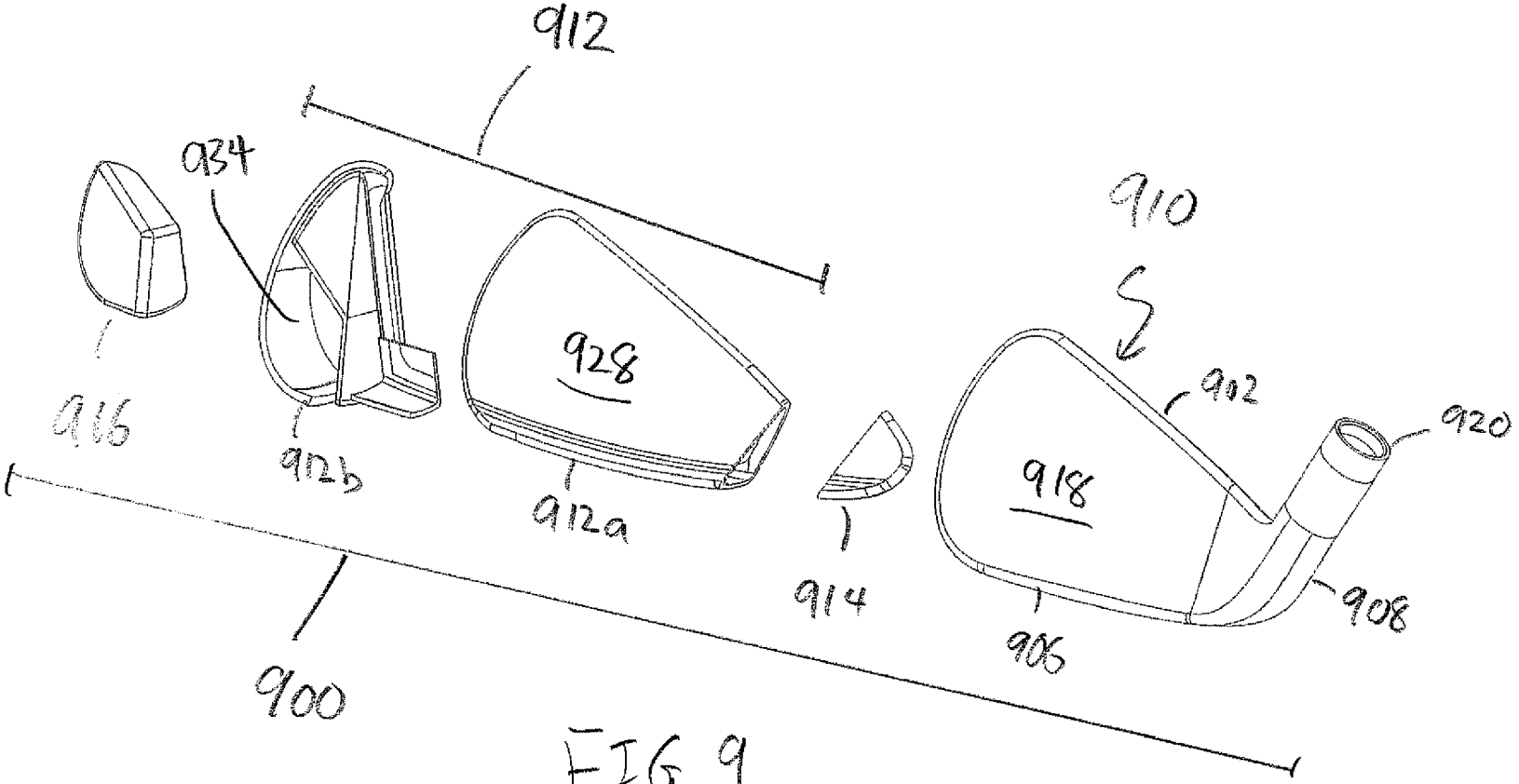
FIG. 9 shows an exploded frontal perspective view of a golf club head in accordance with an alternative embodiment of the present invention.

FIG. 9 of the accompanying drawings shows a frontal exploded view of a golf club head 900 in accordance with an alternative embodiment of the present invention. In this exploded frontal view additional features that were previously not visible from the rear view can be shown more clearly. More specifically, FIG. 9 of the accompanying drawings shows the lightweight toe portion 912*b* may further contain a cavity 934 to allow the toe weight 916 to be incorporated into the golf club head without the need for complicated forming techniques previously discussed. In addition to showing the cavity 934, FIG. 9 of the accompanying drawings still shows some of the basic components originally shown. FIG. 9 shows a golf club head 900 being separated into two major components, a metallic portion 910 and a lightweight portion 912. The metallic portion 910 further comprises a topline portion 902 a sole portion 906, a heel portion 908, a hosel 920, and a striking face 918. The metallic portion 910 is created to allow a heel weight 914 to be inserted into the bottom heel portion of the golf club head 900. The lightweight portion 912, as shown in this current embodiment, can be separated into a lightweight face portion 912*a* and a lightweight toe portion 912*b* similar to the previous embodiment. The lightweight face portion 912*a* has a face support 928 that support the rear portion of the striking face 918.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. An iron golf club head comprising:

a metallic portion further comprising a hosel, a heel portion, a topline portion, a sole portion, and a striking face, wherein said metallic portion creates an opening near a toe side of said metallic portion;

a lightweight portion further comprising an exposed toe portion, a topline support, a sole support, and an internal face support, wherein said lightweight portion slidably engages said opening near said toe side of said metallic portion, wherein said metallic portion conceals said internal face support, said topline support, and said sole support, wherein said exposed toe portion of said lightweight portion is exposed externally and forms an external portion of said iron golf club head; and wherein said iron golf club head further comprises of a heel weight and a toe weight, said heel weight being retained in said iron golf club head by said metallic portion and said toe weight being retained in said iron golf club head by said lightweight portion.

2. The iron golf club head of claim 1, wherein said striking face has a thickness of between about 1.0 mm and about 1.5 mm and said internal face support has a thickness of between about 0.8 mm and about 1.2 mm.

3. The iron golf club head of claim 2, wherein said striking face has a thickness of between about 1.1 mm and about 1.4 mm and said internal face support has a thickness of between about 0.9 mm and about 1.1 mm.

4. The iron golf club head of claim 3, wherein said striking face has a thickness of between 1.2 mm and about 1.4 and said internal face support has a thickness of about 1.0 mm.

5. The iron golf club head of claim 1, wherein said metallic portion is made out of a steel material having a density greater than about 7.0 g/cc and said lightweight portion is made out of a composite type material having a density less than about 3.0 g/cc.

6. The iron golf club head of claim 5, wherein said metallic portion is made out of a steel material having a density greater than about 7.3 g/cc and said lightweight portion is made out of a composite type material having a density less than about 2.5 g/cc.

7. The iron golf club head of claim 6, wherein said metallic portion is made out of a steel material having a density greater than about 7.6 g/cc and said lightweight portion is made out of a composite type material having a density less than about 2.0 g/cc.

8. The iron golf club head of claim 1, wherein said lightweight portion further comprises a lightweight face portion, and a lightweight toe portion, wherein said lightweight face portion comprises said topline support, said sole support, and said internal face support; and wherein said lightweight toe portion further comprises said exposed toe portion.

9. The iron golf club head of claim 8, wherein said lightweight face portion further comprises snap opening and said lightweight toe portion further comprises a tab, wherein said snap opening and said tab engage one another to secure said lightweight face portion to said lightweight toe portion.

10. An iron golf club head comprising:

a metallic portion further comprising a hosel, a heel portion, a topline portion, a sole portion, and a striking face, wherein said metallic portion creates an opening near a toe side of said metallic portion;

a lightweight portion further comprising an exposed toe portion, a topline support, a sole support, and an internal face support, wherein said lightweight portion slidably engages said opening near said toe side of said metallic portion;

a heel weight located at a bottom heel portion of said iron golf club head;

a toe weight, located at a bottom toe portion of said iron golf club head said heel weight being retained in said iron golf club head by said metallic portion and said toe weight being retained in said iron golf club head by said lightweight portion.

11. The iron golf club head of claim 10, wherein said topline support provides structural integrity for said topline portion, said sole support provides structural integrity for said sole portion, and said internal face support provides structural integrity for said striking face.

12. The iron golf club head of claim 11, wherein said topline portion wraps around said topline support and said sole portion wraps around said sole support.

13. The iron golf club head of claim 12, wherein said striking face has a thickness of between about 1.0 mm and about 1.5 mm and said internal face support has a thickness of between about 0.8 mm and about 1.2 mm.

14. The iron golf club head of claim 13, wherein said striking face has a thickness of between about 1.1 mm and about 1.4 mm and said internal face support has a thickness of between about 0.9 mm and about 1.1 mm.

15. The iron golf club head of claim 14, wherein said striking face has a thickness of between 1.2 mm and about 1.4 and said internal face support has a thickness of about 1.0 mm.

16. The iron golf club head of claim 11, wherein said exposed toe portion of said lightweight portion is exposed externally and forms an external portion of said iron golf club head.

17. The iron golf club head of claim 16, wherein said metallic portion is made out of a steel material having a density greater than about 8.0 g/cc and said lightweight portion is made out of a composite type material having a density less than about 2.0 g/cc.

18. The iron golf club head of claim 17, wherein both of said toe weight and said heel weight are made out of a tungsten material having a density greater than about 15.0 g/cc.

19. The iron golf club head of claim 11, wherein said golf club head further comprises a viscoelastic layer sandwiched between said striking face and said internal face support.

* * * * *